US006807510B1

(12) United States Patent
Backstrom et al.

(10) Patent No.: US 6,807,510 B1
(45) Date of Patent: Oct. 19, 2004

(54) MODEL PREDICTIVE CONTROLLER FOR COORDINATED CROSS DIRECTION AND MACHINE DIRECTION CONTROL

(75) Inventors: Johan U. Backstrom, North Vancouver (CA); Pengling He, New Westminister (CA)

(73) Assignee: Honeywell ACSA Inc., Mississauga (CA)

( * ) Notice: Subject to any disclaimer, the term of this patent is extended or adjusted under 35 U.S.C. 154(b) by 0 days.

(21) Appl. No.: 10/430,063

(22) Filed: May 5, 2003

(51) Int. Cl.[7] ..... G06F 19/00; G06F 15/00; G06F 7/66

(52) U.S. Cl. ..... 702/150; 702/33; 702/196; 700/128; 700/129

(58) Field of Search ..... 702/33, 36, 150, 702/155, 189, 196; 700/117, 127, 128, 129

(56) References Cited

U.S. PATENT DOCUMENTS

| | | | | |
|---|---|---|---|---|
| 3,947,668 A | | 3/1976 | Al-Shaikh et al. | |
| 4,374,703 A | | 2/1983 | Lebeau et al. | |
| 4,707,779 A | | 11/1987 | Hu | |
| 4,910,688 A | | 3/1990 | Amini | |
| 4,965,736 A | | 10/1990 | Balakrishnan | |
| 4,982,334 A | | 1/1991 | Balakrishnan | |
| 5,122,963 A | | 6/1992 | Chen | |
| 5,563,809 A | | 10/1996 | Williams et al. | |
| 5,893,055 A | | 4/1999 | Chen | |
| 6,056,781 A | | 5/2000 | Wassick et al. | |
| 6,080,278 A | | 6/2000 | Heaven et al. | |
| 6,094,604 A | * | 7/2000 | Bucher et al. | 700/129 |
| 6,185,468 B1 | | 2/2001 | Wells | |
| 6,233,495 B1 | * | 5/2001 | Chen | 700/122 |
| 6,421,575 B1 | | 7/2002 | Shakespeare | |
| 6,466,839 B1 | | 10/2002 | Heaven et al. | |

* cited by examiner

*Primary Examiner*—Bryan Bui
(74) *Attorney, Agent, or Firm*—Anthony Miologos

(57) ABSTRACT

A process for coordinated control of machine direction MD and cross direction CD actuators in a sheetmaking machine for manufacturing a sheet of material is disclosed. The process involves measuring a plurality of sheet properties at regular intervals to collect sheet measurement data. The sheet measurement data is manipulated to establish a plurality of sheet property measurement arrays, which are then mapped to a common resolution. The common resolution sheet property measurement arrays are concatenated into one larger one-dimensional common resolution measurement array. The common resolution measurement array and an array of past changes in actuator set point are used as inputs to a paper machine process model state observer to generate the estimated current internal state of the sheet manufacturing process. A plurality of future-sheet property target arrays are concatenated into one target array. The array of the estimated current internal state of the web manufacturing process and the paper machine process model are employed to generate an array of future predictions of sheet properties. The array of future predictions of sheet properties, the target array, object function weights, the last actuator set points, and hard constraints are inputted into an object function which is solved to yield optimal changes in the actuator set points for coordinated MD and CD control of the sheet making process.

16 Claims, 2 Drawing Sheets

MODEL PREDICTIVE CONTROLLER FOR COORDINATED CROSS DIRECTION AND MACHINE DIRECTION CONTROL

FIELD OF THE INVENTION

This invention relates to control of a sheet making process, and more particularly to a method for coordinating operation of machine direction and cross direction actuators in a sheet-making machine.

BACKGROUND OF THF INVENTION

The control of sheet properties in a sheet-making machine is concerned with keeping the sheet properties as close to target values as possible. There are two sets of different actuators used for the control of the sheet properties. First, there are machine direction (MD) actuators that only affect the cross direction (CD) average of the sheet property. Each MD actuator can have different dynamic responses in the sheet properties. Second, there are CD actuators that are arrayed across the sheet in the CD. Each array of CD actuators can affect both the average and the CD shape of the sheet properties. CD actuators can have different dynamic responses and different spatial responses in the sheet properties. The problem of overall control of the sheet properties is highly multivariate: one CD actuator in a CD array affects adjacent CD zones in several sheet properties, and the average effect of a CD actuator array intended to control a particular sheet property can affect the average in several sheet properties which are also affected by several MD actuators. The problem is also one of very large scale. A typical control process can have several thousands of outputs (sheet property measurements) and several hundreds of inputs (actuator set points). The process is also difficult or impossible to control in certain spatial and intra actuator set directions.

Today in most conventional sheetmaking equipment, the control of sheet properties is separated into two control problems. First, the CD average is controlled only utilizing the MD actuators, not taking advantage of the CD actuators effect on the CD average of the sheet properties. Second, the CD actuators arrayed across the sheet only utilized to control the CD variation in around the average of the sheet properties. There are MD control schemes available today that utilizes model predictive control with explicit hard constraints handling for coordinating the MD actuators.

Optimal coordinated control of CD actuator arrays controlling one and multiple sheet properties using Model Predictive Control has been discussed in such articles as Backstrom J, Henderson B and Stewart C, "Identification and multivariable control of supercalenders" *Control Systems* 2002, June 2002, Stockholm Sweden and Backstrom J. U, Gheorghe C, Stewart G. E, Vyse R. N "Constrained model predictive control for cross directional multi-array processes". *Pulp & Paper Canada*. T128 102:5 (2001).

The need for coordinating MD actuators and CD actuators was identified in commonly owned U.S. Pat. No. 6,094,604 issued Jul. 25, 2000. A proposed solution to the problem was also disclosed in the '604 patent involving a system of distributed localized intelligent controllers at the actuators that communicated with each other.

SUMMARY OF THE INVENTION

To address the issues outlined above, the present invention provides a flexible large scale Multivariable Model Predictive Controller for coordinated MD and CD control that takes multiple arrays of sheet property measurements as inputs and generates multiple arrays of outputs (actuator set points). The arrays can be of any dimension. An MD array is considered as a 1×1 array. There can be any number of input and output arrays. The invention computes new optimally coordinated set points at evenly spaced control intervals. For each sheet property one can control the CD component only, the MD component only or both the MD and CD component. The inventions predicts the dynamic and spatial 2-dimensional response over a prediction horizon $H_p$ to future $H_c$ actuator set points where $H_c$ is the control horizon. The invention then computes the future optimal set points that bring the future predicted sheet properties as close to target as possible. The controller also takes the physical limitations on the actuators into account explicitly. The controller handles the two types of directional problems by avoiding issuing actuator set points in the difficult spatial and intra actuator set process directions. This ensures closed loop 2-dimensional robust stability.

Accordingly, the present invention provides a process for coordinated control of machine direction MD and cross direction CD actuators in a sheetmaking machine for manufacturing a sheet of material comprising the steps of:

- measuring a plurality of sheet properties at regular intervals to collect sheet measurement data;
- manipulating the sheet measurement data to establish a plurality of sheet property measurement arrays;
- processing the sheet property measurement arrays to establish a one dimensional common resolution measurement array
- generating an array of the estimated current internal state of the sheet manufacturing process;
- establishing a future sheet property target array;
- generating an array of future predictions of sheet properties using the array of the estimated current internal state of the sheet manufacturing process and a sheet machine process model; and
- inputting the array of future predictions of sheet properties, the future sheet property target array, and an array of previous actuator set points into an object function solvable to yield an array of optimal changes in the current actuator set points for coordinated MD and CD control of the sheet making process.

The present invention also provides a process for coordinated control of machine direction MD and cross direction CD actuators in a sheetmaking machine for manufacturing a sheet of material comprising the steps of:

- measuring a plurality of sheet properties at regular intervals to collect sheet measurement data;
- manipulating the sheet measurement data to establish a plurality of sheet property measurement arrays;
- mapping the sheet property measurement arrays to a common resolution;
- concatenating the common resolution sheet property measurement arrays into one larger one-dimensional common resolution measurement array;
- generating an array of the estimated current internal state of the sheet manufacturing process by inputting the common resolution measurement array and an array of past changes in actuator set point to a sheet machine process model state observer;
- concatenating a plurality of future sheet property target arrays into one target array;
- generating an array of future predictions of sheet properties using the array of the estimated current internal state of the sheet manufacturing process and the sheet machine process model;

inputting the array of future predictions of sheet properties, the target array, object function weights, an array of the last actuator set points, and hard constraints into an object function; and solving the object function to yield an array of optimal changes in the current actuator set points for coordinated MD and CD control of the sheet making process.

The present invention acts to optimally manipulate and coordinate the CD actuator arrays and the MD actuators in order to minimize the MD and CD variation in the sheet properties.

The invention optimally coordinates the interaction between MD actuator and CD actuator arrays. The invention further has a general weighting function in the objective function for expressing the cost of moving in small spatial gain directions. The invention further has an explicit weighting function for expressing the cost of moving in small intra actuator set directions. The invention further includes hard constraint specifying an allowable range for CD actuator array set point averages. The invention can be set up to control CD only, MD only or both the CD and MD components of a sheet property.

Preferably, the process of the invention uses one centralized controller rather than multiple distributed controllers.

The invention takes hard actuator constraints explicitly into account.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
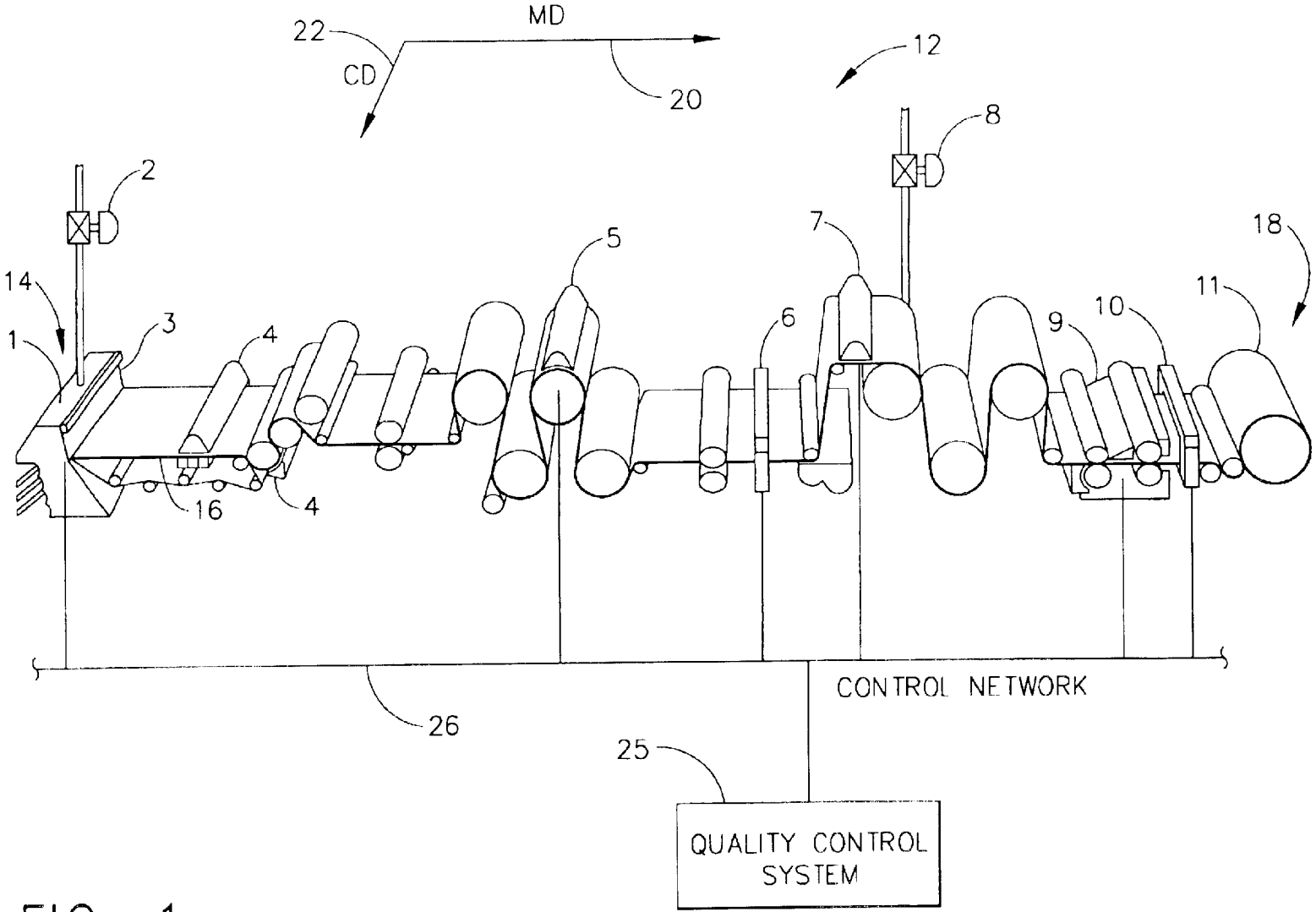
FIG. 1 is a schematic view of a typical sheet making machine operable according to the process of the present invention.

FIG. 1 shows a typical paper machine 12 as an example of a sheet-making machine controllable according to the process of the present invention. Machine direction MD is defined as the direction 20 in which the sheet is being conveyed through the sheet-making machine as the sheet is being manufactured. Cross direction CD is the direction 22 perpendicular to MD. The overall manufacturing process of a paper sheet according to the illustrated paper machine initially involves wood pulp being fed into the head box 1 at the wet end 14 of the machine. Head box 1 acts to thinly distribute the pulp across the width of the paper machine onto a moving wire 16. In the remainder of the paper machine 12, the paper is formed by water removal as the paper sheet under manufacture is conveyed through series of rollers that apply heat and pressure to the sheet. The finished paper sheet is finally wound up on the storage reel 11 at the dry end 18 of the machine.

In order to control the papermaking process, the sheet properties must be constantly measured and the paper machine adjusted to ensure sheet quality. This control is generally achieved by measuring sheet properties at various stages in the manufacturing process, and using this measured information to adjust actuators within the paper machine to compensate for any variations in the sheet properties from a desired target. In the paper machine 12 of FIG. 1, two scanning measurement devices 6 and 10 are used to provide arrays of measurements representing a CD profile of the sheet properties. New CD profiles are obtained at even scan or sampling intervals, which typically range from 10 to 30 seconds. Examples of typical measurement profiles are weight (of dry fibres), moisture, caliper (thickness), gloss and smoothness. The measurement arrays (CD profiles) can have different sizes and typically range from 600 to 2000 elements.

The process of the present invention is preferably implemented as a software application in a Quality Control System (QCS) computer 25. The QCS provides a range of system services that the process of the present invention makes use of. For example, a main system service provided by the QCS is communication interfaces to the measurement devices and the actuators. In FIG. 1, the communication interfaces includes a LAN-like network 26 to interconnect the actuators and the sensors. Another main system service is Human Machine interfaces (HMIs) to the invention. Measurement devices such as scanners or fixed arrays of sensors provide measurements of the sheet properties across the width of the machine. The measurement devices typically have an onboard computer that performs signal processing and provides a communication interface to the QCS computer. There are two types of actuators. First, machine direction (MD) actuators that only affect the whole width of the-sheet, i.e., changing the average value of a sheet property. Second, there are cross direction CD actuator beams that are arrays of actuators that span the whole with of the machine. The CD actuator beams affect both the average of the sheet property and the CD shape of the sheet property. The actuators are typically intelligent with an onboard computer that performs the regulatory control plus communicates with adjacent actuators and a QCS gateway. Such an arrangement is described generally in U.S. Pat. No. 5,771,175 to Spinner et al., entitled "Distributed Intelligence actuator controller with peer-to-peer actuator communication", the disclosure of which is incorporated herein by reference.

An example of an MD actuator in the paper machine of FIG. 1 is the thick stock valve 2 at head box 1, which controls the consistency of the incoming pulp and subsequently affects the MD weight and MD moisture of the paper sheet under manufacture. Another MD actuator shown is the dryer section steam flow valve 8, which regulates the heat provided by the dryer section rolls and subsequently affects the MD moisture and MD caliper of the sheet.

An example of a CD actuator array extending in the cross direction of paper machine 12 in FIG. 1 is the array of slice actuators 3 mounted on head box 1 which act to regulate the area of the head box opening and subsequently affect the CD weight, moisture and caliper of the sheet. Slice actuators 3 can also affect MD weight and moisture if the velocity of pulp flow is maintained constant. CD steam actuators 4 apply steam to the sheet and affect MD and CD moisture and CD caliper. If the CD steam actuator beam is located in the calender stack it will also affect MD and CD gloss and smoothness. CD rewet actuators 5 and 7 apply a fine spray of water to the sheet and affect MD and CD moisture and CD caliper. If the CD rewet actuator is located just prior to a calender stack, the rewet actuators could also affect MD and CD gloss and smoothness. The final CD actuator array shown in FIG. 1 is the induction-heating beam 9 in the calender stack. The induction-heating beam, affects CD caliper, MD and CD gloss and smoothness.

The CD actuators in various arrays can be non-uniformly spaced and typically range from 30 to 200 elements.

The process of the present invention involves taking all the measurement arrays of the sheet properties and optimally computing actuator set points for all MD actuators and CD actuators taking the effect each actuator has on each sheet property into account.

Figure 2:
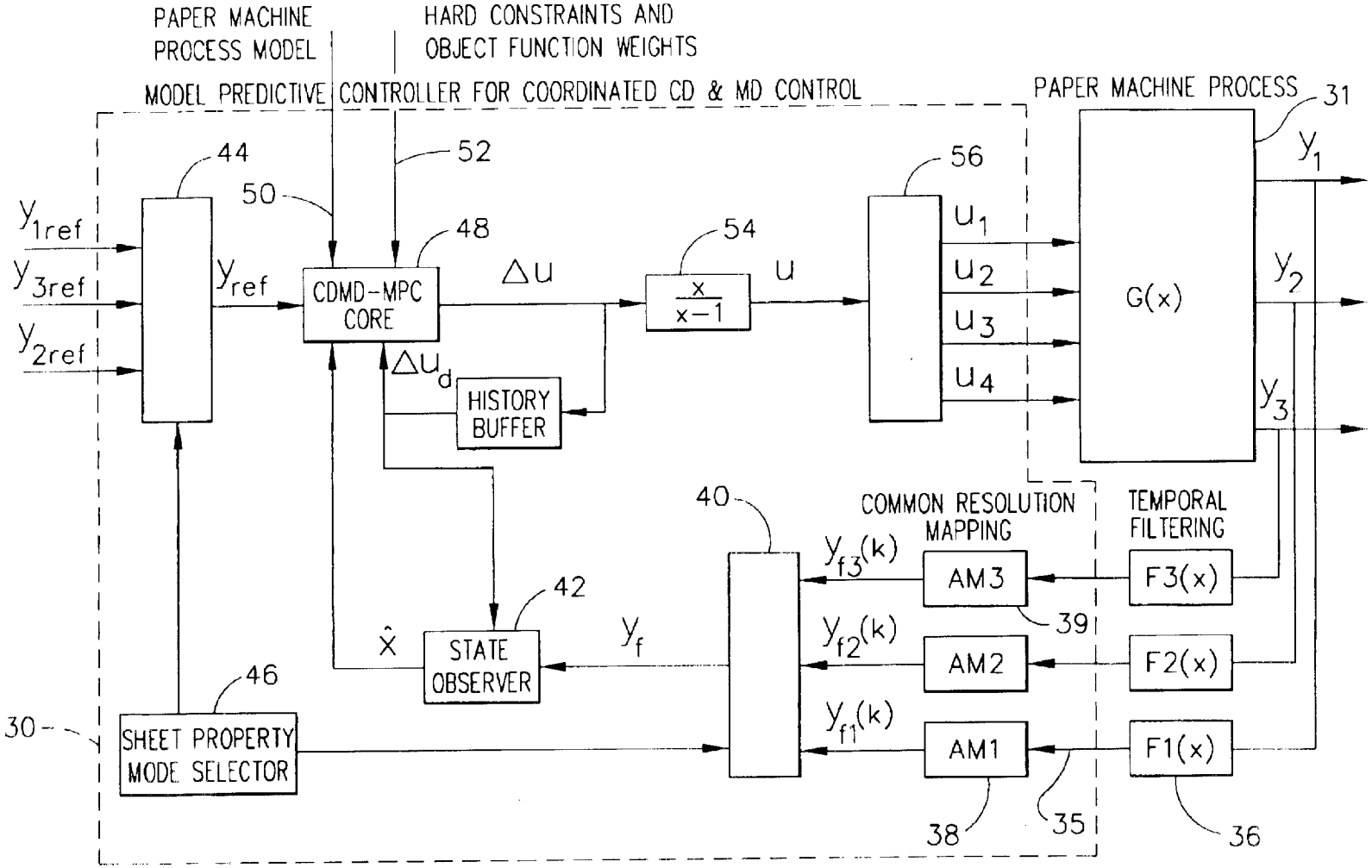
FIG. 2 is a block diagram showing the process steps of the present invention.

FIG. 2 shows a closed loop block diagram of the process of the invention incorporated into a paper machine process. The process of the present invention is defined with the boundary marked with dashed line 30. The paper machine control process is indicated schematically at 31.

Initially, at least one sheet property measurement array is provided as an input array to the process of the present invention. In the block diagram of FIG. 2, three sheet property arrays $y_1(k)$, $y_2(k)$ and $y_3(k)$, representing, for example, weight, moisture and caliper, are provided as input arrays at step 35. k denotes the current sampling instant. It will be apparent to a person skilled in the art that number of sheet property arrays being input to the process of the present invention is dependent only on the sheet properties being measured and controlled.

Each sheet property measurement array can have different dimensions. The sheet property measurement arrays are first typically filtered at step 36 with temporal filters $F_i$ to remove noise and uncontrollable MD variations in the sheet properties using known filtering techniques. Since the temporal filtering is not part of the invention it can be considered as another QCS system service. The filtered sheet property measurement arrays are the inputs to a Common Resolution Mapping Component 39 of the invention, which will be described below.

The input arrays are first mapped to a common resolution $N_{yc}$ at step 38. The common resolution should preferably be greater than three times the highest actuator resolution in order to obtain an accurate two-dimensional process model. The Common Resolution Mapping component 39 ensures that no aliased measurement information is present in the resulting common resolution arrays $y_{f1}(k)$, $y_{f2}(k)$ and $y_{f3}(k)$.

The common resolution measurement arrays are then concatenated into a one dimensional array $y_f(k)$ of dimension $1\times N_{yc}$ at step 40. The concatenated common resolution measurement array $y_f(k)$ and an array of past changes in actuator set points $\Delta u_d(k)$ are then sent to the State Observer Component 42. The State Observer. Component 42 generates an array x(k) that represents an estimated current internal state of the paper machine process based on the concatenated measurement array $y_f(k)$ and the array of past changes in actuator set points $\Delta u_d(k)$.

Each sheet property measurement array is associated with a future sheet property target array $y_{1ref}(k+j)$, $y_{2ref}(k+j)$ and $y_{3ref}(k+j)$, respectively. The future target arrays are provided as a QCS system service based on information provided by the paper machine operator. j>0 represents future sampling instances. Similar to the common resolution measurement arrays of sheet properties, the future sheet property target arrays are concatenated into one larger target array $y_{ref}(k+j)$ at step 44.

The Sheet Property Component Selector Module 46 allows the user to specify if the controller of the present invention should control both the CD and MD component of a sheet property, the CD component only or the MD component only. The Sheet Property Component Selector Module 46 permits modification of the target array $y_{ref}(k+j)$ and the common resolution measurement array $y_f(k)$ to achieve the desired mode.

The estimated current state array x(k), the concatenated future sheet property target array $y_{ref}(k)$ and the array of past changes in actuator set points $\Delta u_d(k)$ array are used as inputs to the CDMD-MPC Core module 48. A model of the paper machine process 50 and object function weights and hard constraints 52 also serve as inputs to CDMD-MPC core module 48. Based on this information, the CDMD-MPC core module 48 generates optimal coordinated set points to bring all sheet properties as close to their targets as possible given the physical limitations (hard constraints) of the actuators.

The calculation of optimal coordinated set points is achieved by the following sub functions:

Based on the estimated current state current internal state array x(k) and the process model, the CDMDMPC Prediction Module generates future predictions of the sheet properties $y_p$ (k+j) where j>0 represents future sampling instances. The paper machine process model is preferably represented in the following state space form $(A,B,C,N_d)$;

$$x(k+1)=Ax(k)+B\Delta u(k-N_d) \tag{1}$$

$$y(k)=Cx(k)$$

where k is the sampling instances, A is the state transition matrix containing the dynamic temporal information of the process, B is the state input matrix containing the static spatial information of the process, C is the state output matrix, and $N_d$ is the process transport delay in samples. The paper machine process model can alternatively be represented in other forms such as an impulse response model, a step response model or a transfer function model. The paper machine process model is preferably obtained using an automated tool for identifying 2 dimensional process models. Such an automated tool is discussed in the reference by Gorinevsky D., Heaven E. M., Gheorghe C, "High performance identification of cross-directional processes" *Control systems* 1998, Povoro, Finland, September 1998, the disclosure of which is incorporated herein by reference.

The future predictions of the sheet properties $y_p(k+j)$ is now passed onto to a QP Formulation Module together with the future target arrays $y_{ref}(k+j)$, object function weights $Q_i$, the last actuator set points u(k−1), the hard constraints and an object function J(t). The object function J(t) is preferably of the form:

$$\min_{\Delta u} J(t) = \min_{\Delta u} \sum_{j=N_d+1}^{H_p} e_p^T(k+j)Q_1e_p(k+j) + \sum_{i=N_d+1}^{H_c-1} \Delta u^T(k+i)Q_2\Delta u(k+i) + u^T(k+i)M^TQ_3Mu(k+i) + [u(k+i)-u_{ref}]^TQ_4[u(k+i)-u_{ref}] + u^T(k+i)S^TQ_5Su(k+i) \tag{2}$$

Subject to: $A\Delta u \leqq b$. $e(k+j)=y_{ref}(k+j)-y_p(k+j)$ are the future predicted errors in the sheet properties. $Q_1$ is a weighting matrix specifying the relative importance between different sheet properties and different CD locations of the sheet. With $Q_1$, one can, for example, specify that moisture is more important than weight and that the centre of the sheet is more important than the edges of the sheet. $Q_2$ is a weighting matrix specifying the cost of large changes in the actuator set points between two consecutive sample instances. M is a matrix that together with a weighting matrix $Q_3$ allow the user to specify the cost for different spatial directions in the actuator set point profiles. A and b are the constraint matrices specifying the hard constraints. Spatial low gain directions needs to be assigned a high cost in order to ensure spatial robust stability of the closed loop system. The low-gain directions correspond to short spatial wavelengths as described in the reference by Stewart G E, Backstrom J. U, Baker P, Gheorghe C and Vyse R. N. Controllability in cross-directional processes: Practical rules for analysis and design. In 87th Annual Meeting, PAPTAC, Montreal, PQ, February 2001, the disclosure of which is incorporated herein by reference. $Q_4$ is a weighting matrix specifying the cost of actuator set points deviating from reference or target set points. For an array of CD actuators, it is common to have an associate actuator set point target from either an actuator energy consumption point of view or a sheet-making machine runnability point of view. S is a matrix that together with the weighting matrix $Q_5$ allow the user to specify the cost of moving the CD actuator arrays and the MD actuators in certain intra actuator set directions. One has to assign a high cost for moving in low intra actuator set gain directions in order to ensure robust stability. The phenomena of intra actuator set directionality for a certain sheet making process is discussed in the reference by Backstrom J, Henderson B and Stewart C, "Identification and multivariable control of supercalenders" Control Systems 2002, June 2002, Stockholm Sweden., the disclosure of which is incorporated herein by reference.

Hard constraints that are taken into account in the process of the present invention are:

1. Actuators that are not under control of the invention, e.g., under operator control or failed, must not be moved to the controller.
2. Actuator set points must be within their physical high and low limit.
3. First and second order bend-limits (only applicable to CD actuator beams).
4. Maintain actuator set point average at a certain limit or within a specified range (only applicable to CD actuator arrays).
5. Maximum change in actuator set points.

The QP Formulation Module takes these inputs and formulates a Quadratic Program in standard form:

$$\frac{1}{2}\Delta u(k)^T \Phi \Delta u(k) + \phi \Delta u(k),\ \Phi = \Phi^T \geq 0 \tag{3}$$

$$A\Delta u(t) \leq b$$

Here $\Phi$ is the Hessian matrix, $\phi$ the Jacobian matrix. A and b are the constraint matrices.

The Quadratic Program in Equation (3) is solved with a highly customized QP solver as discussed in the reference to Bartlett R. A, Biegler L. T., Backstrom J, Gopal V, "Quadratic programming algorithms for large-scale model predictive control" Journal of Process Control, 12 (2002) 775–795. The solution to the Quadratic Program yields an array of the optimal changes in actuator set points $\Delta u(t)$ for coordinated MD and CD control of the sheet making process.

The array of optimal changes in actuator set points $\Delta u(t)$ is then added at step 54 to the last array of actuator set points $\Delta u(t-1)$ to form u(t), which is then split up at step 56 into set points $u_i(t)$ for delivery to the different MD actuators and CD actuator arrays in the paper machine process.

Although the present invention has been described in some detail by way of example for purposes of clarity and understanding, it will be apparent that certain changes and modifications may be practised within the scope of the appended claims.

We claim:

1. A process for coordinated control of machine direction MD and cross direction CD actuators in a sheetmaking machine for manufacturing a sheet of material comprising the steps of:

measuring a plurality of sheet properties at regular intervals to collect sheet measurement data;

manipulating the sheet measurement data to establish a plurality of sheet property measurement arrays;

processing the sheet property measurement arrays to establish a one dimensional common resolution measurement array generating an array of the estimated current internal state of the sheet manufacturing process;

establishing a future sheet property target array;

generating an array of future predictions of sheet properties using the array of the estimated current internal state of the sheet manufacturing process and a sheet machine process model; and inputting the array of future predictions of sheet properties, the future sheet property target array, and an array of previous actuator set points into an object function solvable to yield an array of optimal changes in the current actuator set points for coordinated MD and CD control of the sheet making process.

2. A process as claimed in claim 1 in which the step of processing the sheet property measurement arrays to establish a one dimensional common resolution measurement array involves:

mapping the sheet property measurement arrays to a common resolution; and concatenating the common resolution sheet property measurement arrays into the larger one-dimensional common resolution measurement array.

3. The process of claim 2 in which the step of mapping the sheet property measurement arrays to a common resolution involves selecting the common resolution to be greater than three times the highest actuator resolution.

4. A process as claimed in claim 1 in which the step of generating an array of the estimated current internal state of the sheet manufacturing process involves inputting the common resolution measurement array and the array of past changes in actuator set point into the sheet machine process model state observer.

5. A process as claimed in claim 1 in which the step of establishing a future sheet property target array involves concatenating a plurality of future sheet property target arrays into one target array.

6. A process as claimed in claim 1 in which the step of inputting the array of future predictions of sheet properties, the future sheet property target array, and the array of previous actuator set points into an object function of sheet properties includes inputting object function weights and hard constraints.

7. The process of claim 1 in which the sheet machine process model is represented in the following state space form $(A,B,C,N_d)$;

$$x(k+1)=Ax(k)+B\Delta u(k-N_d)$$

$$y(k)=Cx(k)$$

where k is the sampling instance, x is the array of the estimated current internal state of the process, $\Delta u$ is the array of past changes in actuator set points, A is a state transition matrix containing the dynamic temporal information of the process, B is a state input matrix containing the static spatial information of the process, C is a state output matrix, $N_d$ is a process transport delay in samples.

8. The process of claim 1 in which the sheet machine process model is represented in the form of an impulse response model.

9. The process of claim 1 in which the sheet machine process model is represented in the form of a step response model.

10. The process of claim 1 in which the sheet machine process model is represented in the form of a transfer function model.

11. The process of claim 1 in which the sheet machine process model is generated using an automated tool for identifying 2 dimensional process models.

12. The process of claim 1 in which the object function is of the form:

$$\min_{\Delta u} J(t) = \min_{\Delta u} \sum_{j=N_d+1}^{H_p} e_p^T(k+j)Q_1 e_p(k+j) + \sum_{i=N_d+1}^{H_c-1} \Delta u^T(k+i)Q_2\Delta u(k+i) + u^T(k+i)M^T Q_3 M u(k+i) + [u(k+i)-u_{ref}]^T Q_4 [u(k+i)-u_{ref}] + u^T(k+i)S^T Q_5 S u(k+i) \quad (2)$$

Subject to: $A\Delta u \leqq b$, where $e(k+j)=y_{ref}(k+j)-y_p(k+j)$ are the future predicted errors in the sheet properties, $Q_1$ is a weighting matrix specifying the relative importance between different sheet properties and different CD locations of the sheet, $Q_2$ is a weighting matrix specifying a cost of large changes in the actuator set points between two consecutive sample instances, M is a matrix that together with a weighting matrix $Q_3$ allows the user to specify a cost for different spatial directions in the actuator set point profiles, $Q_4$ is a weighting matrix specifying a cost of actuator set points deviating from reference or target set points, S is a matrix that together with a weighting matrix $Q_5$ allow the user to specify a cost of moving the CD actuator arrays and the MD actuators in certain intra-actuator set directions, and A and b are the constraint matrices specifying the hard constraints.

13. The process of claim 1 in which each MD actuator is considered as a 1×1 array.

14. The process of claim 1 in which the step of manipulating the sheet measurement data to establish a plurality of sheet property measurement arrays comprises:

performing filtering of the sheet property measurement data with temporal filters to remove noise and uncontrollable MD variations in sheet properties.

15. The process of claim 1 including the additional step of specifying which of the MD and CD components of a sheet property are to be controlled.

16. A process for coordinated control of machine direction MD and cross direction CD actuators in a sheetmaking machine for manufacturing a sheet of material comprising the steps of:

measuring a plurality of sheet properties at regular intervals to collect sheet measurement data;

manipulating the sheet measurement data to establish a plurality of sheet property measurement arrays;

mapping the sheet property measurement arrays to a common resolution;

concatenating the common resolution sheet property measurement arrays into one larger one-dimensional common resolution measurement array;

generating an array of the estimated current internal state of the sheet manufacturing process by inputting the common resolution measurement array and an array of past changes in actuator set point to a sheet machine process model state observer;

concatenating a plurality of future sheet property target arrays into one target array;

generating an array of future predictions of sheet properties using the array of the estimated current internal state of the sheet manufacturing process and the sheet machine process model;

inputting the array of future predictions of sheet properties, the target array, object function weights, an array of the last actuator set points, and hard constraints into an object function; and solving the object function to yield an array of optimal changes in the current actuator set points for coordinated MD and CD control of the sheet making process.

* * * * *